United States Patent [19]

Shinohara et al.

[11] 4,058,178

[45] Nov. 15, 1977

[54] HYDRAULIC CYLINDER UNIT

[75] Inventors: Shinitsu Shinohara, Takamatsu; Hisanori Uchino, Tokyo; Hiroyuki Yamaji, Kagawa, all of Japan

[73] Assignee: Tadano Ironworks Co., Ltd., Takamatsu, Japan

[21] Appl. No.: 650,290

[22] Filed: Jan. 19, 1976

Related U.S. Application Data

[60] Continuation-in-part of Ser. No. 500,291, Aug. 26, 1974, abandoned, which is a division of Ser. No. 266,355, June 26, 1972.

[30] Foreign Application Priority Data

Sept. 13, 1971 Japan ..... 46-83664

[51] Int. Cl.[2] ..... F01B 25/26; F01B 31/12

[52] U.S. Cl. ..... 177/146; 73/141 A; 92/5 R; 92/118; 177/211; 212/39 MS; 214/761; 214/762

[58] Field of Search ..... 92/1, 5 R, 114, 118; 177/146, 147, 211; 73/141 A, 88.5 R; 212/39 MS; 214/761, 762, 674

[56] References Cited

U.S. PATENT DOCUMENTS

| | | | |
|---|---|---|---|
| 2,477,854 | 8/1949 | Baker | 73/141 A |
| 3,168,826 | 2/1965 | Paetow | 73/88.5 R |
| 3,178,938 | 4/1965 | Ruge | 73/141 A |
| 3,472,069 | 10/1969 | Webb | 177/211 |
| 3,535,923 | 10/1970 | Martorana | 73/88.5 R |
| 3,621,927 | 11/1971 | Ormond | 73/141 A |
| 3,695,096 | 10/1972 | Kutsay | 73/141 A |
| 3,707,076 | 12/1972 | Jones | 73/141 A |

*Primary Examiner*—Martin P. Schwadron
*Assistant Examiner*—Abraham Hershkovitz

[57] ABSTRACT

A hydraulic cylinder unit which comprises a cylinder, a piston slidably inserted in the cylinder in a fluid-tight manner, and a piston rod connected to the piston at one end thereof and projected outwardly from the cylinder and which is operated to extend the piston rod by a fluid supplied under pressure into one chamber in the cylinder and to retract the piston rod by a mechanical force applied to the piston or piston rod (single-acting type) or by a fluid supplied under pressure into the other chamber in the cylinder (double-acting type) is used for lifting, transporting or displacing a material in various industries. In the use of such hydraulic cylinder unit, load in the axial direction of the unit is applied to the cylinder unit by a load or material carried on operated by the cylinder unit or the piston rod thereof and detection of such load is often required. This load is detected by a strain gauge mounted in the piston rod.

6 Claims, 11 Drawing Figures

HYDRAULIC CYLINDER UNIT

RELATED APPLICATIONS

This application is a continuation-in-part of U.S. patent application Ser. No. 500,291, filed Aug. 26, 1974, and now abandoned which was a division of U.S. patent application Ser. No. 266,355, filed June 26, 1972.

BACKGROUND

Detection of a load in the axial direction of a cylinder unit is required, for example, when a limit load causing a damage of the concerned cylinder unit is to be detected during the use of the unit for preventing such damage, when the weight of a load or material is to be detected, when change of stress applied by a load is to be traced, or when a safety means is to be operated at a predetermined load so that a component operated by the cylinder unit is not damaged. Such detection of load applied to a hydraulic cylinder unit in the axial direction of the same is generally made by detecting the pressure of fluid for operating the cylinder unit, as shown, for example, in U.S. Pat. No. 3,477,854 and U.S. Pat. No. 3,489,294. That is, the former U.S. patent discloses a hydraulic jack weighing device for aircraft and the like wherein a separate fluid chamber is provided which is communicated to a fluid chamber of a fluid cylinder for the jack through a fluid passage, a pressure plate of a deflectible material is arranged at the bottom of the former fluid chamber, and gauges for detecting the deflection of the pressure plate are secured to the bottom face of the pressure plate so that load applied to the fluid cylinder is detected through the fluid pressure and the deflection of the pressure plate whereby the weight of an aircraft or the like which corresponds to the load is measured. In the U.S. Pat. No. 3,489,294, a load limit control for hoisting apparatus is disclosed in which a signal corresponding to a load actually applied to the hoisting apparatus is compared with a safety limit signal corresponding to a safety limit load so that loading to the hoisting apparatus is released or a visual or audible alarm signal is generated when the former signal exceeds the latter safety limit signal. In the load limit control disclosed in the U.S. Pat. No. 3,489,294, the load actually applied to the hoisting apparatus is detected by detecting load applied to a hydraulic cylinder unit for luffing a boom of the hoisting apparatus carrying the load through fluid pressure for the cylinder unit. Such detection of load applied to a hydraulic cylinder unit by means of detection of fluid pressure seems reasonable on the face of it, but the detection is not reliable as will be detailed later.

As another method for detecting load applied to a hydraulic cylinder unit in the axial direction of the same according to the prior art is such in that such load is detected by detecting bending moment of a pivot pin for supporting concerned cylinder unit at the bottom of the unit by means of strain gauge or the like fixedly mounted on the pivot pin. That is, such bottom pivot pin is provided when a load carried by the cylinder unit is to be displaced in directions other than the axial direction of the cylinder unit, and a strain gauge or the like is fixedly mounted on the bottom pivot pin so that load in the axial direction of the cylinder unit is detected by measuring the bending moment of the bottom pivot pin which moment is caused by such load. This method does not provide a reliable detection, too, as will be detailed later.

DESCRIPTION OF THE DRAWING

The invention will fully be detailed in conjunction with the accompanying drawings in which.

DESCRIPTION OF SPECIFIC EMBODIMENT

Figure 1:
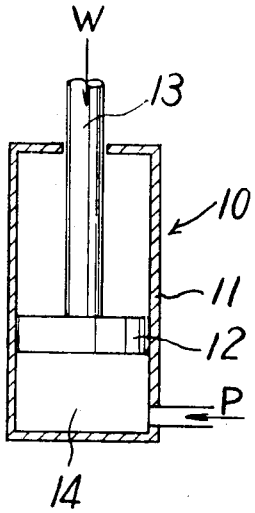
FIG. 1 is a schematic sectional view of a hydraulic cylinder unit of single-acting type.

Referring to the drawings, disadvantages of the methods for detecting load applied to a hydraulic cylinder unit in the axial direction of the same according to the prior art will be explained first in conjunction with FIGS. 1 and 2. In FIG. 1, a hydraulic cylinder unit 10 is shown which comprises a cylinder 11, a piston 12 slidably inserted in the cylinder in a fluid-tight manner, and a piston rod 13 connected to the piston and projected outwardly from the cylinder. The cylinder unit 10 is formed into a single-acting type so that the piston rod 13 is extended by the pressure of a fluid supplied to a chamber 14 below the piston 12 and is retracted by the force applied to the free end of the piston rod 13 by a load (not shown). FIG. 1 is a figure for explaining the aforestated detecting method in which load in the axial direction of the cylinder unit 10 is detected by detecting the fluid pressure applied into the chamber 14. If the load applied to the cylinder unit 10 is W (kg), the effective area of the cylinder 11 is S ($cm^2$), the coefficient of static friction between the cylinder 11 and the piston 12 is $F_s$ (kg) and coefficient of kinetic friction between the cylinder 11 and the piston 12 is Fv (kg), then the fluid pressure P ($kg/cm^2$) applied to the cylinder 11 is expressed as follows:

A. During the upward movement of the piston 12:

$$P = (W + Fv)/S)$$

B. During the downward movement of the piston 12:

$$P = (W - Fv)/S)$$

C. When the piston 12 is at rest:

$$(W - Fs)/S \leqq P \leqq (W + Fs)/S)$$

As can be understood from the foregoing equations, the fluid pressure P varies to a great extent during operation of the cylinder unit 10. Further, the coefficients of friction Fs and Fv vary in response to fluid pressure, temperature, wear of the piston, and the like, and this causes additional variations in the fluid pressure P. Accordingly, when the load W applied to the cylinder unit 10 or the piston 12 thereof is sensed through the fluid pressure thereof by a sensor, the output signal of the sensor may vary widely even if the load W has a constant value, and the output signal is not reliable. In addition, if the cylinder unit is a double-acting one, factors which can cause errors of measurement or detection are compounded. Even if correcting means are provided, correction of the output signal is limited. It is thus seen that the foregoing load-detecting means disclosed in U.S. Pat. No. 2,477,854 and in U.S. Pat. No. 3,489,294 which measure the load applied to a hydraulic cylinder unit by means of the fluid pressure in the unit are not reliable.

Figure 2A:
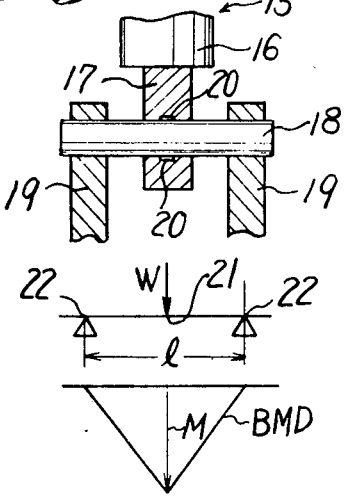
FIGS. 2*a* to 2*f* are schematic sectional views of a part of a hydraulic cylinder unit and bottom pivot pin therefor showing various conditions and bending moment diagrams BMD for such conditions, respectively.

Turning to a consideration of the aforestated load-detecting means in which bending moment of a bottom pivot pin for a hydraulic cylinder unit is detected by a gauge or gauges fixedly mounted on the pivot pin, this load-detecting means is represented in FIGS. 2*a* to 2*f*. As shown in FIGS. 2*a* to 2*f*, a hydraulic cylinder unit 15 or a cylinder 16 thereof is fixedly provided with a bracket 17 at the base end thereof and the cylinder unit 15 is pivotally supported through the bracket 17 by a bottom pivot pin 18 bridged between a pair of brackets or bearings 19. A pair of strain gauges 20 are fixedly mounted on the pivot pin 18 for detecting the bending or bending moment of the pin 18. As shown in FIG. 2*a* showing the normal state, load in the axial direction of the cylinder unit 15 is applied to the pivot pin 18 at load acting point 21 and the pivot pin 18 is supported by the bearings 19 at fulcrums 22. In the normal state shown in FIG. 2*a*, the bending moment M sensed by the gauges 20 is expressed:

$$M = (W \cdot l)/4)$$

where W is the load applied to the cylinder unit 15 and l is the distance between the fulcrums 22 for the pivot pin 18, and bending moment diagram BMD in this normal state is such that is shown in FIG. 2*a*. However, the output signal of the gauges 20 varies widely due to variation in conditions.

Figure 2B:
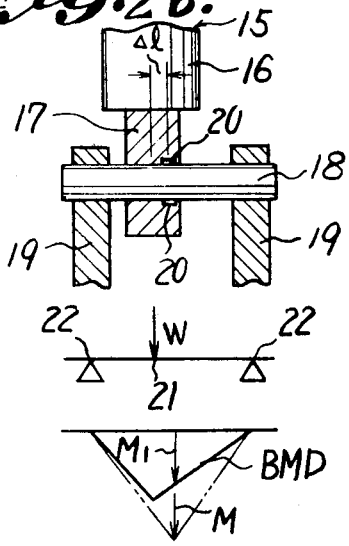

First, when the cylinder unit 15 is displaced along the pivot pin 18 by an amount $\Delta l$ as shown in FIG. 2*b*, the acting point 21 is displaced by $\Delta l$, the Bending Moment Diagram BMD varies as shown in FIG. 2*b*, and the moment $M_1$ actually sensed by the gauges 20 is expressed by:

$$M_1 = M(1 - (2\,\Delta l)/l))$$

Figure 2C:
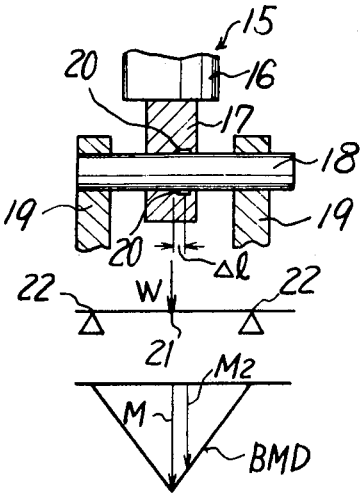

Secondly, when the pivot pin 18 is displaced between the bearings 19 by an amount $\Delta l$ as shown in FIG. 2*c*, the position of the gauges 20 is also displaced by $\Delta l$ from the center between the bearings 19 and the moment $M_2$ actually sensed by the gauges 20 is expressed by:

$$M_2 = M(1 - (2\,\Delta l/l)$$

Figure 2D:
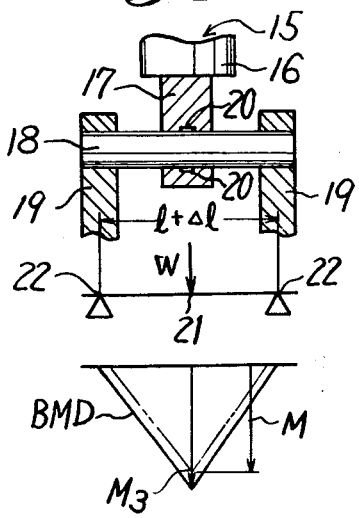

Third, when the distance l between the bearings 19 is changed by an amount $\Delta l$ as shown in FIG. 2*d*, the amount $M_3$ actually sensed by the gauges 20 is expressed by:

$$M_3 = (W \cdot l/4 \pm (W \cdot l)/4)$$

$$= M(1 \pm \Delta l/l)$$

where (+) is the case when the distance l is enlarged by $\Delta l$ and (−) is the case when the distance l is shortened by $\Delta l$.

Figure 2E:
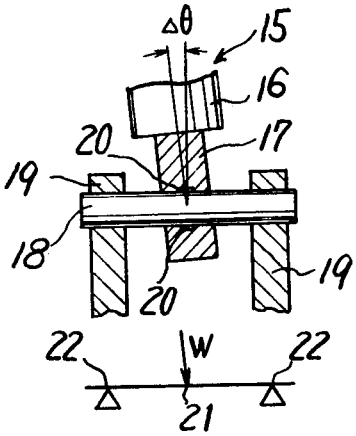

Next, when the cylinder unit 15 is inclined by $\Delta\theta$ as shown in FIG. 2*e*, the load W is applied to the pivot pin 18 from the inclined direction as shown in FIG. 2*e* so that Bending Moment Diagram BMD varies accordingly, whereby the sensed moment varies too. In the state shown in FIG. 2*e*, the supporting area of the pivot pin 18 which supports the cylinder unit 15 is also changed so that an error due to this change of supporting area also arises.

Figure 2F:
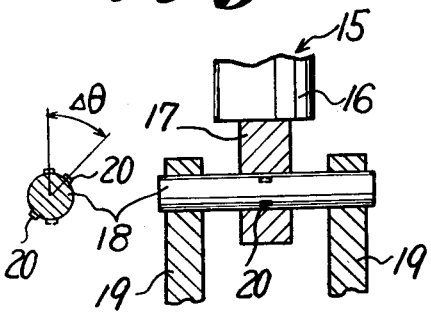

Further, when the pivot pin 18 is rotated through an angle $\Delta\theta$ as shown in FIG. 2*f*, the conversion ratio of the gauges 20 in relation to the moment is changed, although the BMD is the same as the normal BMD, and this also causes errror.

The variations of conditions shown in FIGS. 2*b* to 2*f* may cause the output signal from the gauges 20 to vary widely even if the load W is constant. It is thus seen that the foregoing load-detecting means which measures the load applied to a hydraulic cylinder unit by detecting the bending moment of bottom pivot pin for the cylinder unit is not reliable.

Accordingly, a primary object of the present invention is to provide a novel hydraulic cylinder unit having a load-detecting means which detects load applied to the cylinder unit in the axial direction of the unit in a reliable manner.

Another object of the present invention is to provide a novel hydraulic cylinder unit in which, although it has such load-detecting means, stroke of extending and retreating operation of the cylinder unit is maintained large.

Still another object of the present invention is to provide a hydraulic cylinder unit in which gauge or gauges for detecting load is or are prevented from damage in an effective manner.

Figure 3:
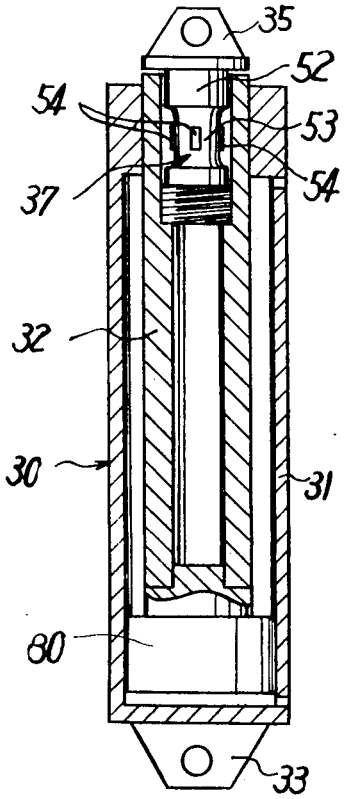
FIG. 3 is a vertical sectional view of an embodiment of the hydraulic cylinder unit according to the present invention.

Referring to FIG. 3, there is shown an embodiment of the hydraulic cylinder unit according to the present invention. As is usual, the hydraulic cylinder unit shown comprises a cylinder means having a cylinder 31 which means is to be connected to a base (not shown), a piston 80 axially slidably inserted in the cylinder 31 of the cylinder means in a fluid tight manner between a retracted position shown and a fully extended position, and a rigid piston rod means having a piston rod or rod member 32 which means is to be connected to a load (not shown) which is to be carried by the cylinder unit. The cylinder means further includes a bottom bracket 33 fixedly secured to the cylinder 31 at the bottom of the cylinder, and the rigid piston rod means which is fixedly secured at the base end thereof to the piston 80 further includes a top bracket 35. In using the hydraulic cylinder unit, the cylinder means is connected pivotally to the base by a pivot pin extending through and across the bottom bracket 33 such as a pivot pin 34 shown in FIG. 4 and the piston rod means is connected to the load by a pivot pin extending through and across the top bracket 35 such as a pivot pin 36 shown in FIG. 4.

In the hydraulic cylinder unit 30 shown in FIG. 3, the rod member 32 of the piston rod means is formed into a hollow one having an opening at the top. In the hollow space in the rod member 32 is inserted from the top opening thereof and screwed a support member 52 to which the top bracket 35 is fixedly secured at the free end of the support member. Load-detecting means 37 for this cylinder unit 30 which means is fixedly mounted on the piston rod means according to the present invention is mounted on the support member 52. That is, the support member 52 has a narrowed neck 53 and four strain gauges 54 or the like of the load-detecting means 37 are attached to the periphery of this neck 53 of the support member 52 with intervals of 90° therebetween. The strain gauges 54 detect strain of the support member 52 in the axial direction of it. The load-detecting means 37 provides an electrical output signal in response to the strain detected by the gauges 54.

Figure 4:
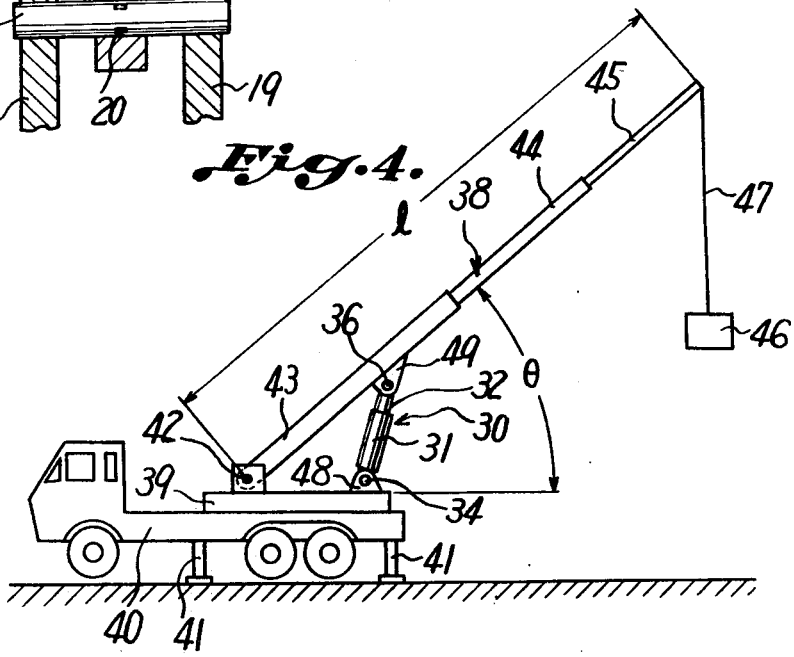
FIG. 4 is an elevational side view of a crane showing a use of the hydraulic cylinder unit according to the present invention.

In FIG. 4, an example of the use of the hydraulic cylinder unit 30 is shown. The cylinder unit 30 is employed in a crane for the purpose of luffing the boom 38 of the crane. The crane shown includes a base body 39 which is installed on a truck 40 so that the crane may be revolved horizontally by 360°. In operating the crane, the truck 40 is lifted by four outriggers or supporting legs 41 together with the base body 39 with keeping the ground plane of the body 39 horizontal. The boom 38 is mounted on the base body 39 so that the boom may be revolved upwardly and downwardly about a horizontally arranged supporting shaft 42 supported by the body 39. The boom 38 is formed into a three-stage extensible boom which comprises a non-extensible base boom member 43 and two telescopically extensible boom members 44 and 45 which may be extended and contracted, as is usual, by respective hydraulic cylinder units (not shown) arranged in the boom between the respective two adjacent boom members, so that the span of the boom 38 can be changed variously. As is usual, a load 46 is carried by the boom 38 by means of a wire-rope 47.

On the base body 39 is fixedly provided a bracket 48 to which the bottom bracket 33 of the cylinder unit 30 or the cylinder means thereof is faced. The cylinder unit 30 is supported to the base body 39 by the bottom pivot pin 34 which extends horizontally through the brackets 33 and 48. To the non-extensible boom member 43 is fixedly secured a bracket 49 to which the top bracket 35 of the cylinder unit 30 or the piston rod means thereof is faced. The piston rod 32 of the cylinder unit 30 is connected to the boom 38 by the top pivot pin 36 which extends horizontally through the brackets 35 and 49. The boom 38 is thus revolved around the shaft 42 by the extending and retracting operation of the hydraulic cylinder unit 30 so that lift angle $\theta$ of the boom 38 varies.

A load is applied to the cylinder unit 30 in the axial direction of the unit by the moment applied to the boom 38 by the load 46 and the empty load of the boom 38. The moment applied to the boom 38 varies by the change of the load 46 and also by the changes of the span l and lift angle $\theta$ of the boom 38 so that the load applied to the cylinder unit in the axial direction thereof varies variously. Such load is directly applied to the piston rod means of the cylinder unit 30 in the direction of the unit or piston rod means thereof so that compressive stress is caused in the piston rod means or the support member 52 thereof. Such compressive stress is equal to the load applied to the cylinder unit 30 in the axial direction of the unit because the load is balanced with the sum of force caused by fluid pressure in the cylinder unit and force of friction between the piston and cylinder of the unit so that a compressive stress equal to the load applied to the cylinder unit in the axial direction thereof is caused in the piston rod means or the support member 52 thereof as the piston 80 moves between the retracted and fully extended positions. Strain of the support member 52 is thus exactly proportional to the load in the axial direction of the cylinder unit 30 so that a reliable detection of this load is achieved.

Because the load-detecting means 37 shown in FIG. 3 or each of the gauges 54 thereof is arranged within a hollow space of the piston rod means, provision of such load-detecting means 37 or the gauges 54 thereof requires no enlargement of the length of the piston rod means. In other words, the stroke of the piston rod means is maintained large notwithstanding the provision of the gauges. Further, the load-detecting means 37 or each of the strain gauges 54 thereof is protected from damage by the piston rod means owing to such arrangement of the detecting means 37 or the gauges 54 thereof within the piston rod means or the hollow space therein. In addition, provision of the strain gauges 54 to the periphery of the narrowed neck 53 of the support member 52 enhances the accuracy of detection because the neck 53 is largely strained due to reduced diameter thereof.

Figure 5:
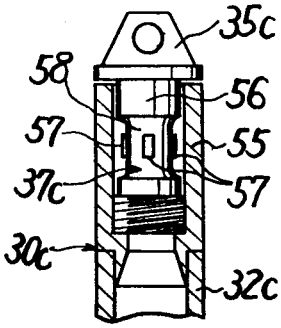
FIG. 5 is a vertical sectional view of a part of another embodiment of the hydraulic cylinder unit according to the present invention.

In FIG. 5, there is shown a modification of the hydraulic cylinder unit 30 shown in FIG. 3. In the hydraulic cylinder unit **30*c* shown in FIG. 5 in which parts similar to those shown in FIG. 3 are designated by numerals similar to the numerals used in FIG. 3 but accompanied with suffix "c", a cylindrical attachment 55 having an outside diameter equal to the outside diameter of the rod memer 32*c* of the piston rod means is fixedly secured to the top end of the rod member 32*c* by welding. A support member 56 is inserted into the cylindrical attachment 55 from the top opening thereof and is screwed to the attachment. Load-detecting means 37*c* for this cylinder unit 39*c* is supported by the support member 56. That is, the load-detecting means 37*c* comprises four strain gauges 57 which are attached to the periphery of the support member 56 at the neck 58 thereof. The load-detecting means 37*c* provides an electrical output signal corresponding to the load applied to the cylinder unit 30*c* in the axial direction of the unit in response to strain detected by the gauges 57. To the support member 56 is fixedly secured a top bracket 35*c* which is projected outwardly from the top opening of the cylindrical attachment 55**.

Figure 6:
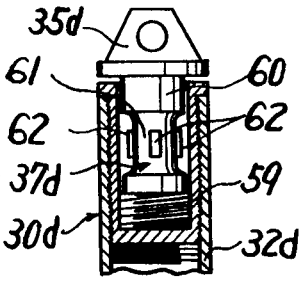
FIG. 6 is a vertical sectional view of a part of a further embodiment of the hydraulic cylinder unit according to the present invention.

In FIG. 6, there is shown another modification of the hydraulic cylinder unit 30 shown in FIG. 3. In the hydraulic cylinder unit **30*d* shown in FIG. 8 in which parts similar to those shown in FIG. 3 are designated by numerals similar to the numerals used in FIG. 3** but accompanied with suffix "*d*", the rod member **32*d* of the piston rod means is formed into a hollow one having an opening at the top. A cylindrical attachment 59 having a top opening is inserted into the rod member 32*d* from the top opening of the rod member and is screwed to the rod member 32*d*. Further, a support member 60 having a neck 61 is inserted into the cylindrical attachment 59 and is screwed to the attachment 59. Load-detecting means 37*d* for this cylinder unit 30*d* is supported by the support member 60. That is, the load-detecting means 37*d* comprises four strain gauges 62 which are attached to the periphery of the support member 60 at the neck 61 thereof. The load-detecting means 37*d* provides an electrical output signal corresponding to the load applied to the cylinder unit 30*d* in the axial direction of the cylinder unit in response to the strain detected by the gauges 62. To the support member 50 is fixedly secured a top bracket 35*d* which is projected outwardly from the top opening of the cylindrical attachment 59**.

Each of the hydraulic cylinder units 30*c* and 30*d* shown in FIGS. 5 and 6 may be substituted for the hydraulic cylinder unit 30 for the crane shown in FIG. 4. Further, it is needless to say that each of the cylinder units 30*c* and 30 *d* has advantages similar to those of the cylinder unit 30 shown in FIG. 3.

What is claimed is:

1. In a hydraulic cylinder unit comprising:

a. a cylinder means pivotally connected to a base;

b. a piston axially slidably inserted in the cylinder means in a fluid-tight manner between a retracted position and a fully extended position, said piston being extended by hydraulic pressure supplied to said cylinder means; and c. a rigid piston rod means connected to the piston at base end thereof and projected outwardly from the cylinder means, the piston rod means being connected to a load which is to be carried by the cylinder unit, load-detecting means for detecting load applied to the cylinder unit in the axial direction of the cylinder unit which means is arranged within a hollow space provided in said rigid piston rod means and is mounted on one of the components of said piston rod means which component is strained by a load carried by the cylinder unit as the piston moves between the retracted and fully extended positions, the load-detecting means including at least one gauge for detecting strain of said component, the load-detecting means providing an electrical output signal corresponding to the load in response to strain detected by the gauge.

2. The structure of claim 1 in which said rigid piston rod comprises a rod member connected to said piston at base end thereof and having a hollow end and a support member inserted in the hollow end of the rod member at base portion thereof and secured to the rod member and projected outwardly from the rod member, said at least one gauge being fixedly mounted on the support member at within the hollow end of the rod member.

3. The structure of claim 2 in which said rod member of the piston rod includes a first portion and a cylindrical attachment fixedly secured to the first portion, said hollow end of the rod member being provided by the cylindrical attachment.

4. The structure of claim 3 in which said cylindrical attachment has an outside diameter equal to the outside diameter of said first portion of the rod member, the cylindrical attachment being fixedly secured to the free end of the first portion.

5. The structure of claim 3 in which said first portion of the rod member has a hollow end, said cylindrical attachment of the rod member being mounted within the hollow end of the first portion.

6. The structure of claim 2 in which said support member of the piston rod means has a narrowed neck, said at least one gauge being fixedly mounted on the support member at the neck.

* * * * *